US010077572B1

(12) United States Patent
Bowen

(10) Patent No.: US 10,077,572 B1
(45) Date of Patent: Sep. 18, 2018

(54) SYSTEMS AND METHODS FOR LIFTING AND POSITIONING A ROOF FOR INSTALLATION ON A STORAGE TANK

(71) Applicant: HMT LLC, The Woodlands, TX (US)

(72) Inventor: Shane Allen Bowen, Pinehurst, TX (US)

(73) Assignee: HMT, LLC, The Woodlands, TX (US)

( * ) Notice: Subject to any disclaimer, the term of this patent is extended or adjusted under 35 U.S.C. 154(b) by 0 days.

(21) Appl. No.: 15/491,704

(22) Filed: Apr. 19, 2017

(51) Int. Cl.

| | |
|---|---|
| ***E04H 7/00*** | (2006.01) |
| ***E04D 15/00*** | (2006.01) |
| ***B66D 1/08*** | (2006.01) |
| ***B66D 1/48*** | (2006.01) |

(52) U.S. Cl.
CPC ..... *E04H 7/00* (2013.01); *B66D 1/08* (2013.01); *B66D 1/485* (2013.01); *E04D 15/00* (2013.01); *B66D 2700/0133* (2013.01)

(58) Field of Classification Search
CPC .. E04H 7/00; B66D 1/485; B66D 1/08; B66D 2700/0133; E04D 15/00
See application file for complete search history.

(56) References Cited

U.S. PATENT DOCUMENTS 2,341,890 A * 2/1944 Wiggins ..... B65D 88/34 182/106
3,059,596 A * 10/1962 Pretini ..... G08B 13/20 109/21
3,398,269 A * 8/1968 Williams ..... G01S 13/587 324/76.33
3,745,224 A * 7/1973 Ames ..... F27B 3/08 373/84
4,312,157 A * 1/1982 Hertel ..... A01G 9/242 52/13
4,446,751 A * 5/1984 Andreasen ..... B65D 90/64 105/29.1
4,522,320 A * 6/1985 Andreasen ..... B65D 90/64 222/484
4,607,987 A * 8/1986 Kice ..... B65G 53/66 239/76
6,155,005 A * 12/2000 McNamara ..... E04B 1/0007 52/169.6

(Continued)

FOREIGN PATENT DOCUMENTS

CN 200978479 Y * 11/2007
CN 201193404 Y * 2/2009

(Continued)

*Primary Examiner* — Jeanette E Chapman
(74) *Attorney, Agent, or Firm* — Fletcher Yoder, P.C.

(57) ABSTRACT

A system includes a plurality of lifts configured to couple to a storage tank about the storage tank, a reservoir to store compressed air, and a manifold. Each lift includes a hoist, a coupling to extend between the hoist and a roof of the storage tank, an inlet conduit to be coupled to an inlet of the hoist, and an outlet conduit to be coupled to an outlet of the hoist. A pressure difference between the inlet of the hoist and the outlet of the hoist spools the hoist. The manifold fluidly couples the reservoir to each inlet conduit and fluidly couples each outlet conduit to an exhaust. The manifold includes a plurality of outlet valves, each coupled to one outlet conduit of the plurality of outlet conduits and configured to regulate flow between the outlets of the plurality of hoists and the exhaust.

10 Claims, 6 Drawing Sheets

(56) References Cited

U.S. PATENT DOCUMENTS

| | | | | |
|---|---|---|---|---|
| 6,227,357 | B1 * | 5/2001 | Brown, Sr. | B25H 1/04 198/861.1 |
| 6,460,827 | B1 * | 10/2002 | Baucom | B66F 5/04 254/134 |
| 2004/0055081 | A1 * | 3/2004 | Wilson | E04H 4/084 4/498 |
| 2006/0091590 | A1 * | 5/2006 | Arthur | F27B 3/24 266/193 |
| 2006/0218911 | A1 * | 10/2006 | Bickley | F02C 7/232 60/426 |
| 2006/0272324 | A1 * | 12/2006 | Hedman | F15B 1/265 60/412 |
| 2008/0104890 | A1 * | 5/2008 | Starheim | E06B 3/01 49/346 |
| 2009/0044332 | A1 * | 2/2009 | Parsell | A61G 7/0533 5/11 |
| 2012/0048230 | A1 * | 3/2012 | Darrow | F01C 1/3441 123/236 |

FOREIGN PATENT DOCUMENTS

| | | | | | |
|---|---|---|---|---|---|
| CN | 101852019 | A | * | 10/2010 | |
| CN | 104213714 | A | * | 12/2014 | |
| CN | 106639396 | A | * | 5/2017 | |
| JP | 04060061 | A | * | 2/1992 | |
| JP | 07286363 | A | * | 10/1995 | |
| JP | 11006325 | A | * | 1/1999 | |
| JP | 2016074534 | A | * | 5/2016 | |
| WO | WO-2012025645 | A2 | * | 3/2012 | E04B 1/3533 |

* cited by examiner

SYSTEMS AND METHODS FOR LIFTING AND POSITIONING A ROOF FOR INSTALLATION ON A STORAGE TANK

BACKGROUND

The present disclosure relates generally to the installation of roofs. More specifically, the present disclosure relates to improved techniques for lifting and positioning a dome roof on a storage tank.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Above ground storage tanks are frequently used to store industrial quantities of a variety of raw and finished materials. These storage tanks may contain liquids, gases, solids, or some combination thereof and are used in a variety of industries. For example, the oil and gas industry frequently uses above ground storage tanks to store refined hydrocarbon products. Additionally, above ground storage tanks are also common in the petrochemical, pharmaceutical, cosmetics, food, and consumer products industries.

A variety of storage tanks may be used across all industries. For example, a storage tank may be cylindrically shaped with a fixed roof. The fixed roof, as opposed to an open top storage tank (e.g., a hopper), has the benefit of minimizing evaporation of liquid product in the tank. Moreover, a fixed roof limits contamination of the stored product by keeping foreign matter (e.g., water, dust, etc.) out of the tank. Fixed roofs come in a variety of configurations including flat, coned, umbrella, domed, etc. The roof shape may be based on the intended application of the storage tank. For example, a domed roof may be better suited for higher pressure applications because the curved structure typically distributes pressure better than a flat roof.

A dome roof is one of many different kinds of roofs that may be used on storage tanks. Dome roofs are typically self-supported, spherical segment frame structures. Current methods of dome roof construction have created several challenges for the industry. Dome roofs are typically assembled on the ground, or a surface near a base of the tank (e.g., inside or outside the tank), and then lifted into position for installation. Conventional techniques for lifting a dome include positioning multiple manually operated grip hoists about a circumference of the tank, at or near a top rim of the tank. The grip hoists are coupled to the dome using couplings (e.g., chains, cables, ropes, webbing, etc.). The lifts are then manually actuated by one or more operators positioned at each lift to the dome roof from the base of the tank to the top rim of the tank. Due to manufacturing tolerances and wear, the grip hoists may operate at different rates or speeds. Accordingly, coordinating movement of the lifts can be difficult and time consuming. For example, if the lifts do not lift the dome roof at the same speed, the dome may tilt in one direction, such that the weight of the dome is not evenly distributed among the lifts. Leveling a tilted dome before installation may add time to dome installation. Further, to change each grip hoist from "lift" mode to "lower" mode may take a two-man team as long as ten minutes or more, thereby decreasing the efficiency of the installation process.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In a first embodiment, a system includes a plurality of lifts configured to couple to a storage tank about a circumference of the storage tank, a reservoir configured to store compressed air, and a manifold. Each lift of the plurality of lifts includes a hoist, a coupling configured to extend between the hoist and a roof of the storage tank, an inlet conduit configured to be coupled to an inlet of the hoist, and an outlet conduit configured to be coupled to an outlet of the hoist. A pressure difference between the inlet of the hoist and the outlet of the hoist spools the hoist. The manifold is configured to fluidly couple the reservoir to each inlet conduit of the plurality of inlet conduits and to fluidly couple each outlet conduit of the plurality of outlet conduits to an exhaust. The manifold includes a plurality of outlet valves, wherein each outlet valve of the plurality of outlet valves is coupled to one outlet conduit of the plurality of outlet conduits and wherein the plurality of outlet valves is configured to regulate flow between the outlets of the plurality of hoists and the exhaust.

In another embodiment a method includes pressurizing a reservoir with compressed air, wherein the reservoir is fluidly coupled to a first inlet of a first hoist via a first inlet conduit, exhausting air from a first outlet of the first hoist, via a first outlet valve of a manifold, to create a first pressure differential between the first inlet and the first outlet of the first hoist, spooling the first hoist, and lifting a roof of a tank with the first hoist, wherein the first outlet of the first hoist is fluidly coupled to the manifold via a first outlet conduit.

In a further embodiment, a controller includes a non-transitory tangible computer readable medium comprising executable instructions that when executed cause a processor to open at least one of a plurality of inlet valves of a manifold to level a plurality of hoists, wherein the plurality of inlet valves are coupled to a plurality of inlet conduits, wherein each inlet conduit of the plurality of inlet conduits fluidly couples a respective inlet of one hoist of the plurality of hoists to a reservoir of compressed air, and open at least one of a plurality of outlet valves of the manifold, wherein the plurality of outlet valves is coupled to a plurality of outlet conduits, wherein each outlet conduit of the plurality of outlet conduits fluidly couples a respective outlet of one hoist of the plurality of hoists to an exhaust. Opening at least one of the plurality of outlet valves exhausts air from the outlet of a respective hoist of the plurality of hoists, thereby creating a pressure difference between the inlet and the outlet of the respective hoist of the plurality of hoists, spooling the respective hoist of the plurality of hoists, and thereby lifting a dome roof for installation on a storage tank.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
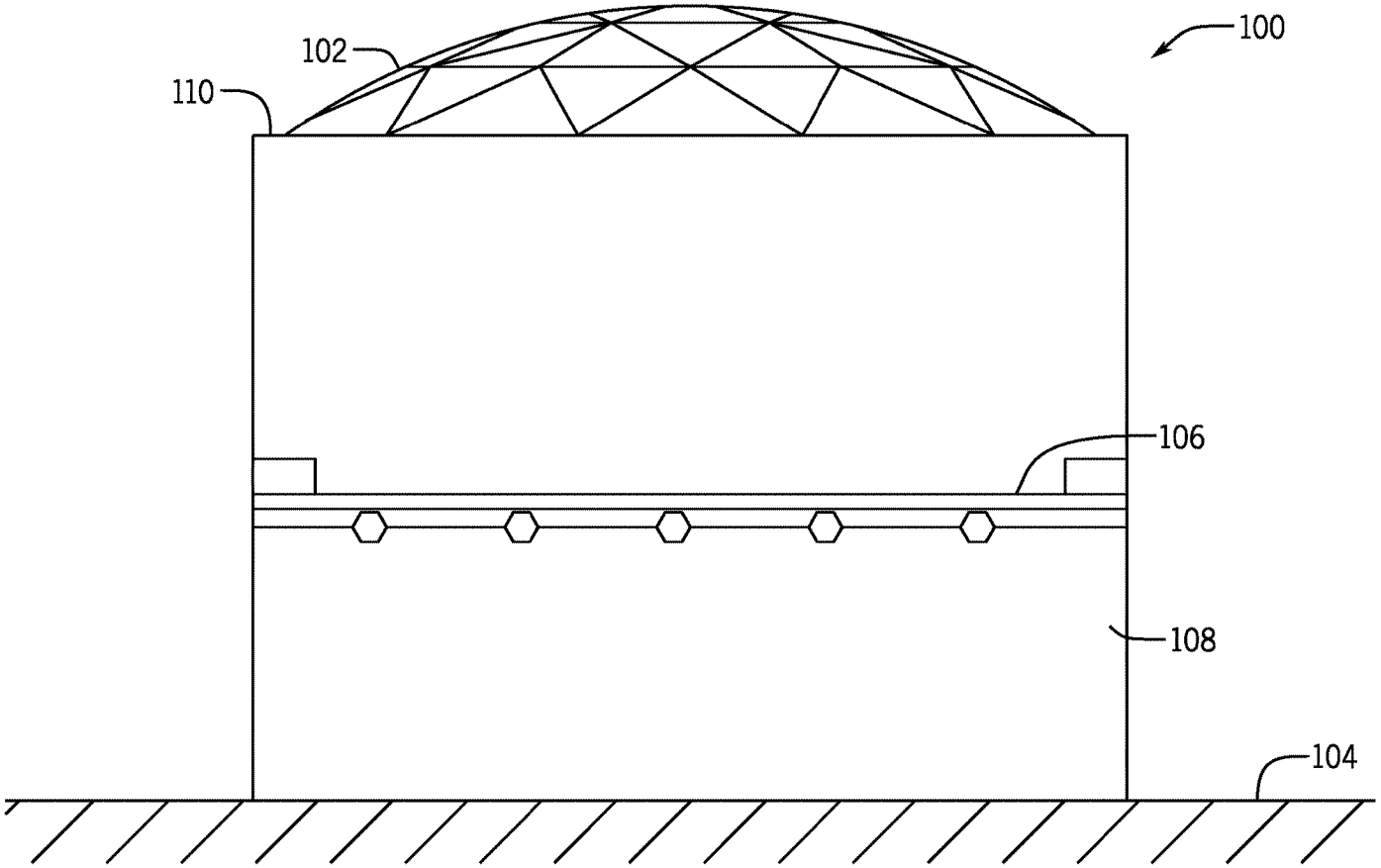
FIG. 1 is a schematic side view of a storage tank having a dome roof, in accordance with an embodiment of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with systems-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more elements. The terms "comprising," "including," and "having" are intended to be inclusive and mean that there may be additional elements other than the listed elements.

Conventional techniques for lifting a dome roof for installation on a storage tank include using a crane or manually operated grip hoists. Wear and manufacturing tolerances of grip hoists may result in a set of grip hoists spooling at different speeds, which may result in inadvertent or undesired tilting of the dome roof during lifting or lowering of the dome roof. Accordingly, coordinating movement of multiple manually operated hoists can be difficult. Further, two-stroke grip hoists may pause each time an actuation lever reaches the end of its stroke, which may result in non-continuous or uneven lifting. Two-stroke grip hoists are put in a lift mode or a lower mode, in which the grip hoist can only lift or lower, but not both. Switching each grip hoist from lift mode to lower mode may take a two-man team as long as ten minutes to complete. As a result, the process of lifting the dome roof can be time consuming and may take multiple attempts. The present disclosure is directed toward systems and methods for lifting the dome roof for installation atop the storage tank. For example, the disclosed embodiments include a plurality of lifts disposed about a circumference of the storage tank, each lift having an inlet conduit (e.g., fluid inlet) and an outlet conduit (e.g., fluid outlet) fluidly coupled between a hoist and a manifold. The manifold includes a plurality of valves that control flow through the inlet conduits and outlet conduits. In reaction to a pressure difference between an inlet of the hoist and an outlet of the hoist, the hoist spools to dissipate the pressure difference. By opening the valves on the outlet conduits, air may be exhausted from the outlets of the hoists, causing the hoists to spool and lift the dome roof, in a continuous and reliable manner. The resulting system offers increased efficiency, better coordination between lifts, and substantial time savings in installing a dome roof when compared to previously existing techniques.

Referring now to FIG. 1, a side view of a storage tank 100 is shown. The storage tank 100 may be a cylindrical storage tank with a dome roof 102. Though the dome roof 102 is shown in FIG. 1, it should be understood that the disclosed techniques may be used in other applications to lift other kinds of roofs (e.g., flat roofs). In the illustrated embodiment, the storage tank 100 is positioned on a surface 104 (e.g., a concrete foundation, the ground, a structural base, etc.) and is equipped with an internal floating roof 106. The storage tank 100 may contain some type of material or product 108. The product 108 may be hydrocarbons, synthetic chemicals, water, or any other type of substance capable of being stored in the storage tank 100. Moreover, the product 108 may be a gas, liquid, solid, or some combination thereof (hereinafter referred to generally as "fluid"). Additionally, the storage tank 100 may also include other additional components that are not shown in FIG. 1.

As described in more detail below, the dome roof 102 may be assembled on the ground 104 and lifted into position at or near a top rim 110 of the tank 100. Typically, the dome roof 102 is lifted using multiple manually operated lifts positioned about the circumference of the tank 100. However, coordinating the rate or speed at which each lift raises the dome roof 102 can be difficult and can increase the time to install the dome roof 102. For example, the lifting process may be halted to level the doom roof 102 as different lifts may be operated at different speeds. The use of a centralized control system to coordinate movement of the lifts may allow for the use of pneumatic or hydraulic lifts and substantially reduce the time and cost associated with installing a dome roof 102 atop the tank 100.

Figure 2:
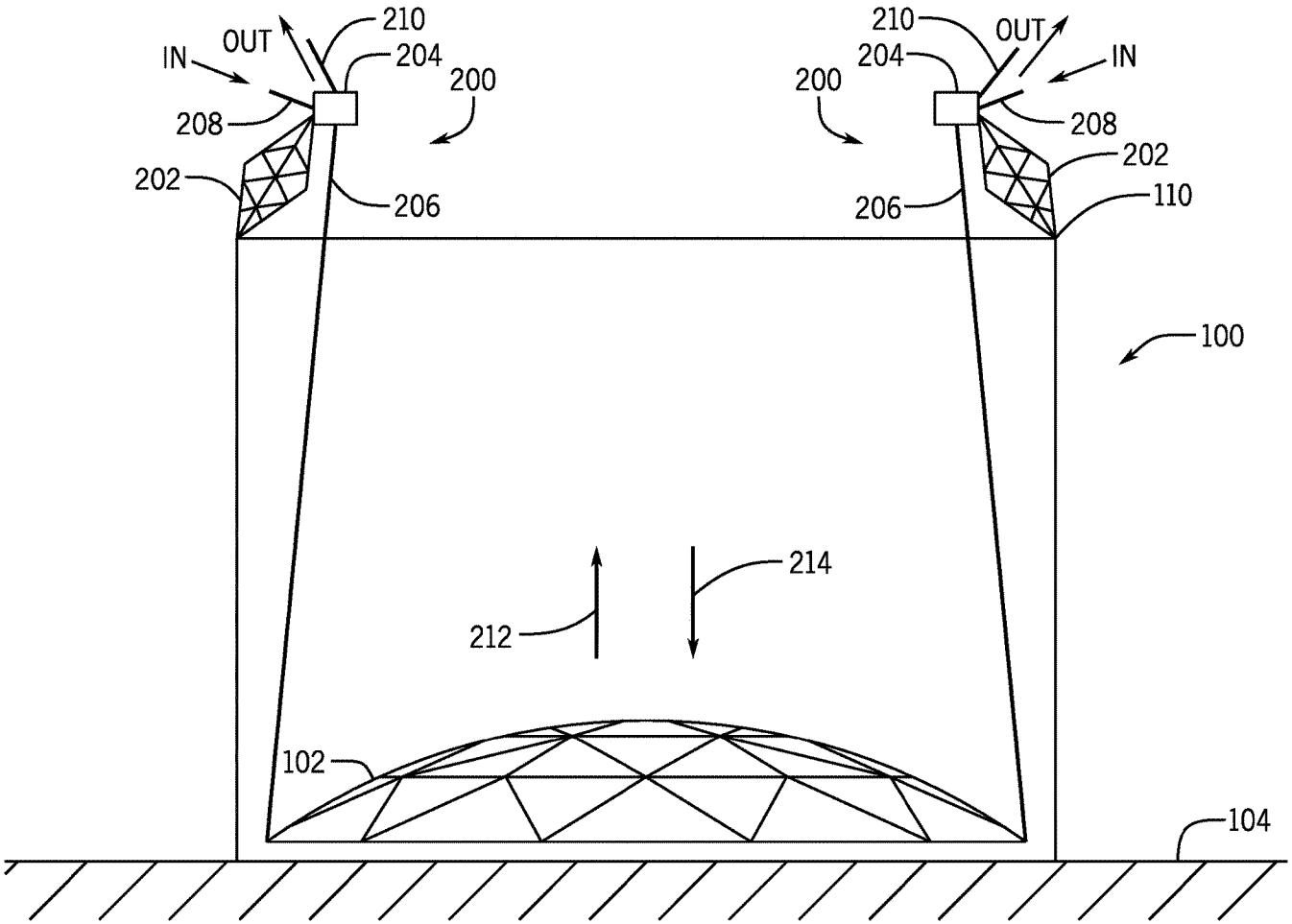
FIG. 2 is a schematic side view of the storage tank shown in FIG. 1 with the dome roof assembled within the storage tank, in accordance with an embodiment of the present disclosure.

FIG. 2 is a side view of an embodiment of the storage tank 100 of FIG. 1 with the dome roof 102 assembled and sitting within the storage tank 100 ready for installation. As shown, multiple lifts 200 are coupled to the top rim 110 of the storage tank 100 to lift the dome roof 102 into position at the top of the tank 100. Each lift 200 includes a support structure 202, a hoist 204 (e.g., a pneumatic hoist), and a chain 206. The support structure 202 couples to the storage tank 100 at or near the top rim 110 of the storage tank 100 and positions the hoist 204 radially inward from the top rim 110, such that the hoist 204 is positioned above the dome roof 102. The support structure 202 may be a generally two-dimensional structure (e.g., a truss) that couples to the storage tank 100 in one place, or a three-dimensional structure that couples to the storage tank 100 in multiple places. The chain 206 couples to the dome roof 102 and extends upward to the hoist 204. In some embodiments, a cable, webbing, rope, or some other coupling may be used instead of the chain 206. The hoist 204 runs back and forth along the chain 206. Because the position of the hoist remains fixed, when the hoist runs, it has the effect of raising or lowering the chain, moving the dome roof 102 up and down. As shown, each hoist 204 includes an inlet conduit 208 and an outlet conduit 210. The inlet conduit 208 and the outlet conduit 210 may be configured to direct flows of pneumatic or hydraulic fluid (e.g., air, oil, etc.) to effectuate operation of the hoist 204. As will be described in more detail with regard to FIG. 3, the hoist 204 may react to a pressure difference between the inlet conduit 208 and the outlet conduit 210 by rotating or spooling back and forth to equalize the pressures, thus moving the chain 206 back and forth through the hoist 204. Because the hoists 204 are stationary, as the hoists 204 feed the chains 206 or spool in a first direction, the dome 102 moves upward (arrow 212). As the hoists 204 feed the chains 206 or spool in a second direction, the dome 102 moves downward (arrow 214).

Figure 3:
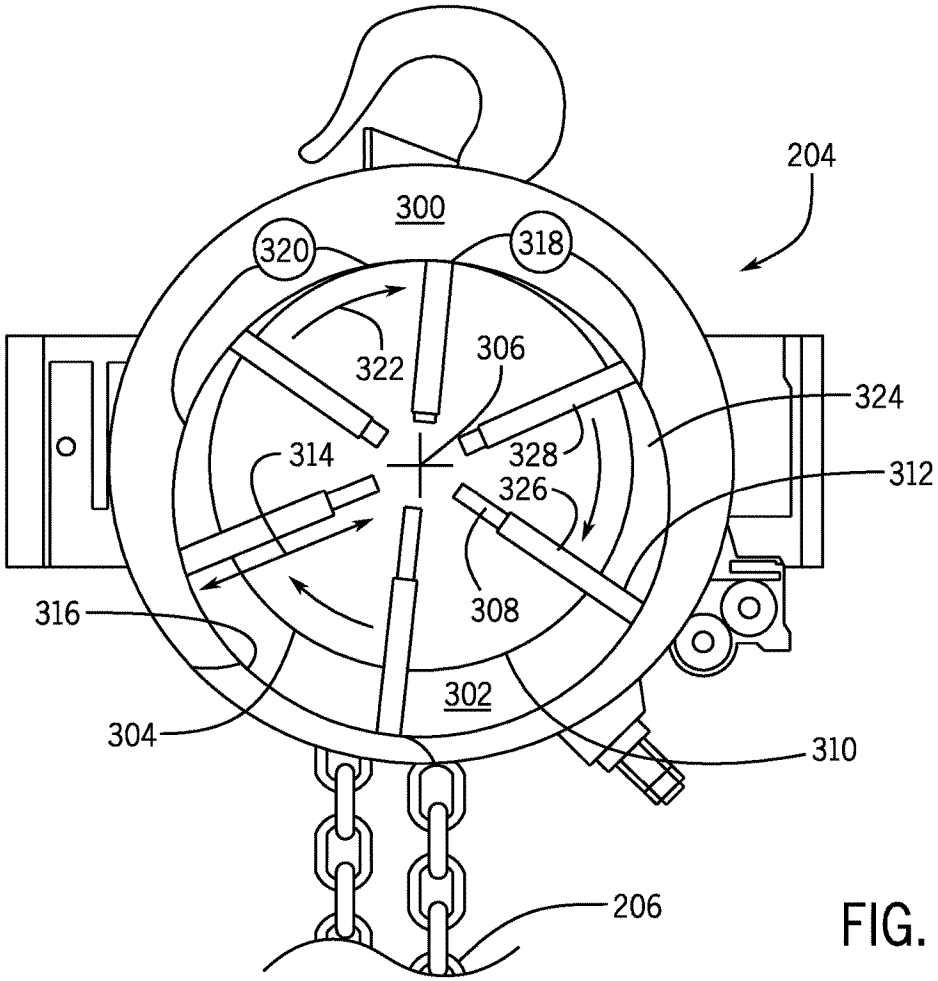
FIG. 3 is a side, section view of a hoist shown in FIG. 2, in accordance with an embodiment of the present disclosure.

FIG. 3 is a side, section view of an embodiment of one of the hoists 204 shown in FIG. 2. As shown, the hoist 204 includes a body 300, which defines an eccentric chamber 302. A circular shaft 304 is disposed within the chamber 302 and rotates about an axis 306. The shaft 304 includes a plurality of slots 308 that extend radially inward from a radially exterior surface 310 of the shaft toward the axis 306 about which the shaft 304 rotates. A respective fin 312 extends into each of the slots 308. In some embodiments, the depth of each fin 312 may be substantially the same as the depth of each slot 308. In other embodiments, the fins 312 may be of a different depth than each slot 308. As the shaft 304 rotates within the chamber 302 about the axis 306, the fins 312 move radially within the slots 308 (arrow 314, relative to the axis 306) to stay in contact with the interior surface 316 of the body 300. The inlet conduit 208 (see FIG. 2) is in fluid communication with an inlet 318, and the outlet conduit 210 is in fluid communication with an outlet 320.

During operation, a volume 324 of the chamber 302 between a first fin 326 and a second fin 328 is under pressure. The force of the pressure acts uniformly per unit of surface area of each fin 326, 328. However, because the first fin 326 has a larger surface area exposed to the volume 324 than the second fin 328, the pressure applies more force to the first fin 326 than the second fin 328, resulting in rotation of the shaft 304. A pressure difference between the inlet 318 and the outlet 320 causes the shaft 304 to rotate to equalize the pressures. For example, when the pressure at the inlet 318 is greater than the pressure at the outlet 320, the shaft 304 rotates in clockwise direction (arrow 322). The rotating shaft 304 causes a toothed sprocket to rotate, feeding the chain 206 in the first direction, lifting the dome 102 (see FIG. 2). In some embodiments, the shaft 304 may feed the chain 206 directly. In other embodiments, one or more gears may be disposed between the shaft 304 and the chain 206. In embodiments that use a coupling other than a chain (e.g., a cable, rope, webbing, etc.), the hoist may spool the coupling, or interface with the coupling in a different way than the toothed sprocket.

Correspondingly, when the pressure at the inlet 318 is less than the pressure at the outlet 320, the shaft rotates in a counter-clockwise direction (opposite arrow 322). The rotating shaft 304 causes the toothed sprocket to rotate, feeding the chain 206 in the second direction, lowering the dome 102 (see FIG. 2). The pressures at the inlet 318 and outlet 320 of each hoist 204 may be controlled via a manifold 400 (see FIG. 4).

Figure 4:
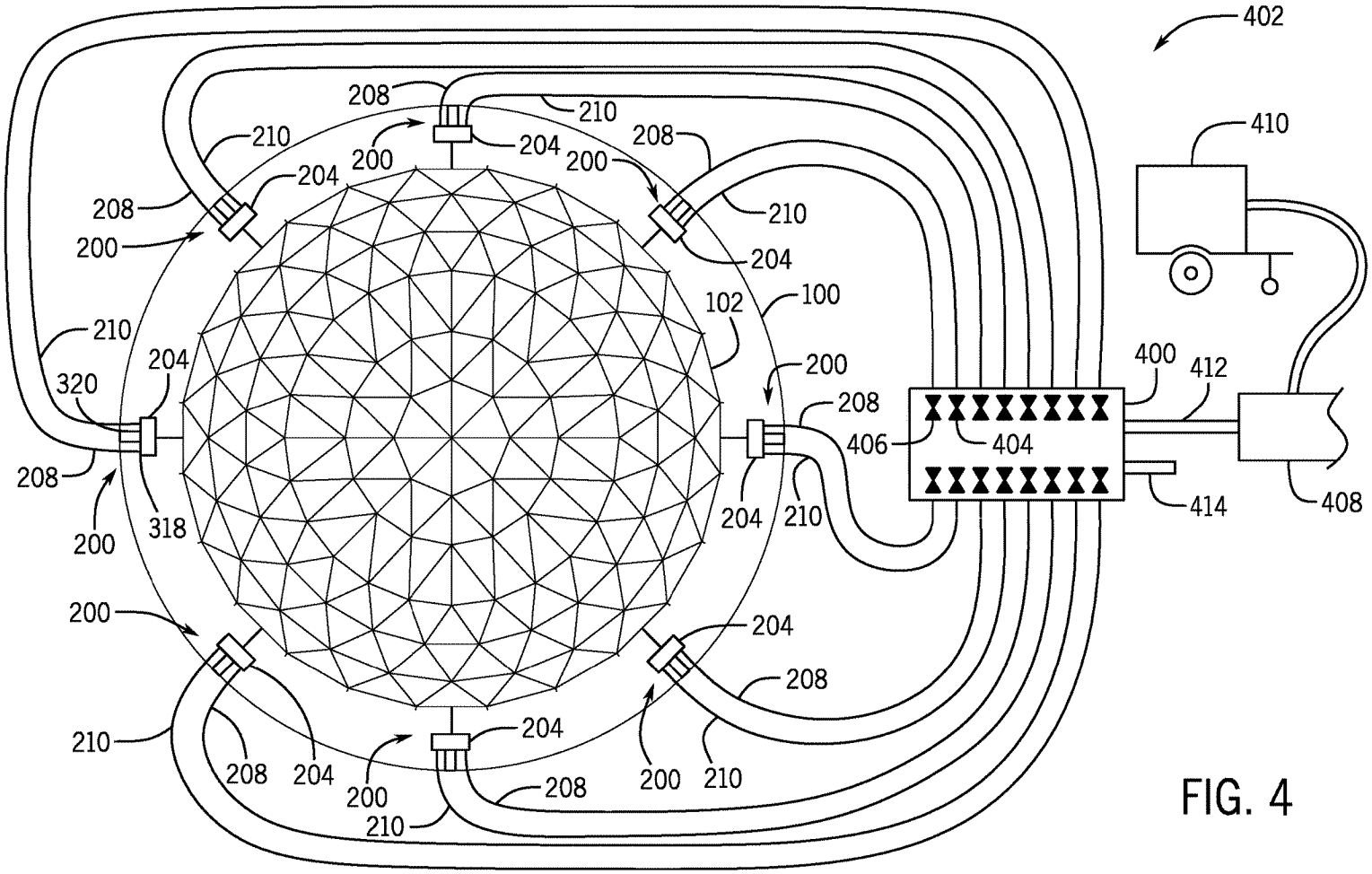
FIG. 4 is a schematic top view of a system for lifting the dome roof for installation on the storage tank, in accordance with an embodiment of the present disclosure.

FIG. 4 is a top view of a system 402 for lifting the dome roof 102 for installation on the storage tank 100. As shown, eight lifts 200 are distributed about the circumference of the storage tank 100. It should be noted however, that other embodiments of the system 402 may include a different number of lifts 200. For example, the system 402 may include 1, 2, 3, 4, 5, 6, 7, 9, 10, 11, 12, 13, 14, 15, 16, 17, 18, 19, 20, or more lifts 200. Similarly, systems 402 for large dome roofs 102 (e.g., 300 ft diameter and larger) may utilize multiple manifolds 400. Each lift 200 is coupled to the respective inlet conduit 208 and the respective outlet conduit 210, which are in fluid communication with the manifold 400. The manifold 400 may include a number of valves (e.g., inlet valves 404 and outlet valves 406), which control pressures in the respective inlet conduits 208 and outlet conduits 210 running to each hoist 204. The valves 404, 406 may be manually or electronically actuated. The valves 404, 406 may include needle valves, ball valves, butterfly valves, clapper valves, check valves, choke valves, diaphragm valves, gate valves, globe valves, knife valves, pinch valves, piston valves, plug valves, poppet valves, spool valves, or any other suitable other kind of valve. In certain embodiments, the manifold 400 may receive compressed air from a reservoir 408. Pressure in the reservoir 408 may be maintained by a compressor 410. In some embodiments, the compressor 410 may be power by standard 110V or 220V utility power. Applications operating at 220V or more may be considered "hot work" applications. For some applications, logistics may be simplified by avoiding hot work by operating at less than 220V (e.g., 110V). For more remote applications, the compressor 410 may include a generator.

In the illustrated embodiment, the manifold 400 receives compressed air from the reservoir 408 via a compressed air conduit 412. The various inlet conduits 208 of the system 402 are in fluid communication with the compressed air conduit 412 in order to provide compressed air to the respective inlet 318 of each hoist 204. As shown, the inlet valves 404 may be disposed between each inlet conduit 208 and the compressed air conduit 412, or along each inlet conduit 208 in order to help regulate the flow of compressed air to each inlet 318. Some embodiments of the system 402 may not include inlet valves 404. Instead, certain systems 402 may rely on the compressor 410 to maintain a substantially constant pressure in the reservoir 408, which is in fluid communication with the inlets 318 the hoists 204 without valves disposed between the reservoir 408 and the hoists 204. In such an embodiment, the hoists 204 would be actuated by using the outlet valves 406 to exhaust air from the outlet 320 of each hoist 204.

The manifold also includes an exhaust 414 in fluid communication with each of the outlet conduits 210. The outlet valves 406 may be used to regulate the flow of air through the outlet conduits 210 and to the exhaust 414. When the outlet valves 406 are opened, air flows through the outlet conduits 210 and out of the exhaust 414, reducing the pressure at the outlets 320 of the hoists 204. The pressure difference between the inlet 318 and the outlet 320 of each hoist 204 causes the hoist 204 to spool, thus lifting the dome roof 102.

Figure 5:
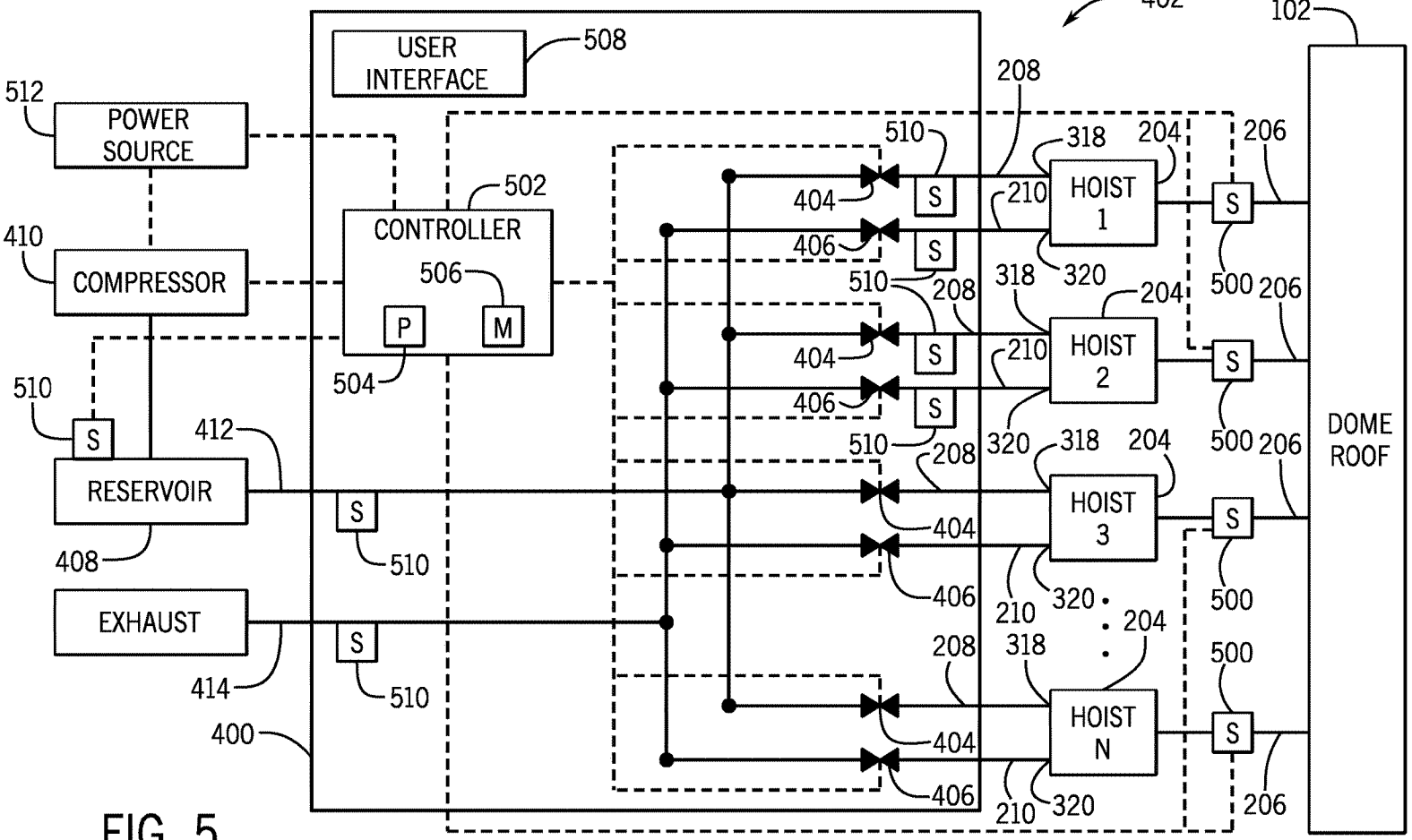
FIG. 5 is a schematic view of the system shown in FIG. 4, in accordance with an embodiment of the present disclosure.

FIG. 5 is a schematic of an embodiment of the system 402 shown in FIG. 4, which is capable of automatic or semi-automatic control. As previously described, the compressor 410 provides compressed air to the reservoir 408 to pressurize the reservoir 408. The compressed air conduit 412 fluidly couples the various inlet conduits 208 to the reservoir 408 via the manifold 400. The manifold 400 may include the inlet valves 404 for controlling the pressure applied to the inlet 318 of each hoist 204. The exhaust 414 is in fluid communication with the outlet conduits 210 via the manifold 400. Outlet valves 406 within the manifold 400 may be actuated to release pressure through the outlet 320 of each hoist 204. The exhaust 414 may be in fluid communication with ambient air, or an exhaust reservoir. A pressure difference between the inlet 318 and the outlet 320 of a hoist 204 causes the hoist 204 to spool, feeding the chain 206 through the hoist 204, raising or lowering the dome roof 201. As illustrated in FIG. 5, some embodiments of the system 402 may include weight sensors 500 (e.g., strain gauges) coupled to one or more of the chains 206 for determining the amount of weight supported by each chain 206. Based on these readings, the system may be able to determine whether or not the dome roof 201 is level. In addition, or in the alternative, the dome roof 201 may be equipped with one or more inclinometers to determine whether or not the dome roof 201 is level.

The system 402 may also include a controller 502, which may be incorporated within or may be separate from the manifold 400. The controller 502 may include a processor 504 and a memory 506. The processor 504 may be one or more general-purpose processors, one or more application-specific integrated circuits, one or more field programmable gate arrays, or the like. The memory 506 may be any tangible, non-transitory, computer readable medium that is capable of storing instructions executable by the processor 504 and/or data that may be processed by the processor 504. In other words, the memory 506 may include volatile memory, such as random access memory, or non-volatile memory, such as hard disk drives, read-only memory, optical disks, flash memory, and the like.

In some embodiments, the controller 502 receives signals from the sensors 500 and controls the position of the valves 404, 406 to control the position of the dome roof 102 based on the feedback from the sensors 500. In the illustrated embodiment, the system 402 also includes a user interface 508, which may include buttons (e.g., "up", "down", "stop"). In other embodiments, the user interface 508 may include a display and one or more user inputs (buttons, mouse, keyboard, touchscreen, etc.) by which a user navigates menus, commands, and/or functions on the display to control the system 402. The user interface 508 and the controller 502 may combine to provide automatic or semi-automatic control of the system 402. For example, in one embodiment, the user may control the position of each of the valves 404, 406 via the user interface 508. In another embodiment, the user may merely input "up", "down", or "stop", and the controller 502 controls the positions of the valves 404, 406 to move the dome roof 102 as directed and keep the dome roof 102 level while it is raised or lowered. In another embodiment, the user may enter a series of preferences and/or settings (e.g., dome height, dome size, desired dome raise/lower rate, maximum and minimum dome raise/lower rates, maximum weight distribution tolerance, and so on) and then the controller 402 automatically lifts the dome roof 102. In some embodiments, the controller 502 may also controls the operation of the compressor 410. For example, the system 402 may include a pressure sensor 510 in the reservoir 408. The controller 502 may control the operation of the compressor 410 such that the pressure within the reservoir 408 stays within a desired window or range of values. Similarly, some or all of the inlet conduits 208, the outlet conduits 210, the compressed air conduit 412, and the exhaust 414 may be equipped with pressure sensors 510 that are in communication with the controller 502.

As illustrated in FIG. 5, the system 402 may include a power source 512 to provide power to the controller 502, the compressor 410, the valves 404, 406, or some combination thereof. In some embodiments, the power source 512 may be a standard utility outlet for providing 110V or 220V. In other embodiments, the power source 512 may be a generator. Use of power above 110V may be considered "hot work." To simplify logistics, it may be advantageous to use a 110V power supply.

Figure 6:
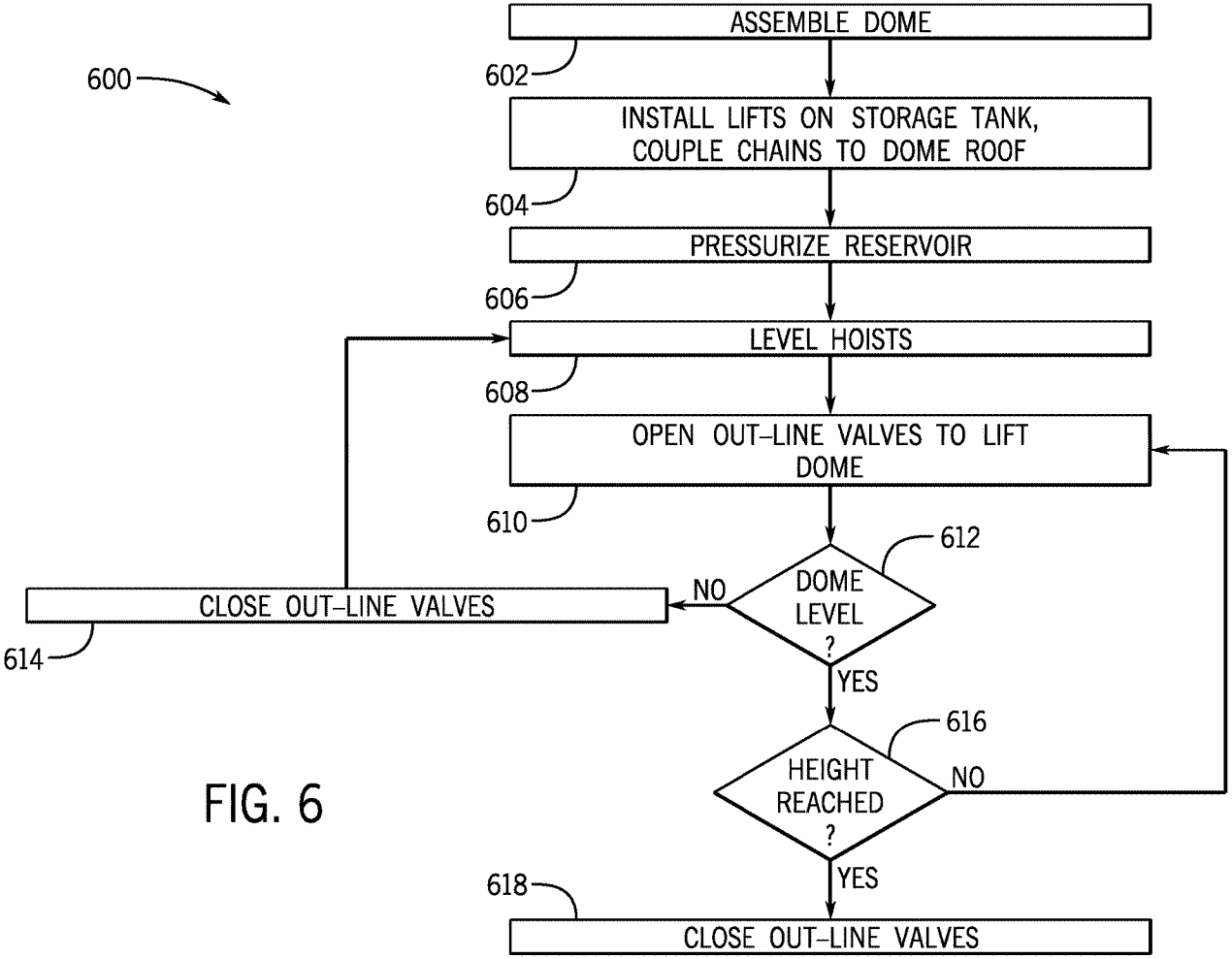
FIG. 6 is a flow chart of a process for lifting the dome roof for installation on the storage tank, in accordance with an embodiment of the present disclosure.

FIG. 6 is a flow chart for a process 600 of lifting the dome roof 102 with the system 402 for installation on the storage tank 100. In block 602, the dome roof 102 is assembled. The dome roof 102 may be assembled on site, or assembled off site and shipped to the location of the storage tank 100 installation. Dome roofs 102 assembled on site may be assembled inside or outside of the storage tank 100. In some embodiments, the lifts 200 may be used during dome roof 102 assembly.

In block 604, the lifts 200 are installed on the storage tank 100. The number of lifts 200 may be based on the size of the dome roof 102. For example, 1, 2, 3, 4, 5, 6, 7, 8, 9, 10, 11, 12, 13, 14, 15, 16, 17, 18, 19, 20, or more lifts 200 may be used. In some embodiments, two or more manifolds 400 may be used (e.g., two manifolds 400 with eight lifts 200 each, or some other combination). As previously discussed with regard to FIG. 2, the lifts 200 may be installed at or near the top lip 110 of the storage tank 100. Each lift 200 may include the support structure 202, the hoist 204, and the chain 206, which is coupled between each hoist 204 and the dome roof 102. Each hoist 204 is coupled to the inlet conduit 208 and the outlet conduit 210. Based on the pressure difference between the inlet conduit 208 and the outlet conduit 210, the hoist 204 may spool in the first direction or the second direction, feeding the chain through the hoist 204 and lifting or lowering the dome roof 102. The inlet conduits 208 and outlet conduits 210 for the various lifts 200 may be coupled to the manifold 400. The manifold may include the valves 404, 406 that control flow through the inlet conduits 208 and outlet conduits 210. The inlet conduits 208 may be fluidly coupled to, and receive compressed air from, the reservoir 408 and/or the compressor 410. The outlet conduits 210 may be fluidly coupled to the exhaust 414, which may exhaust air to ambient or to an exhaust reservoir. In some embodiments, the manifold 400 may include the user interface 508 and/or the controller 502. As previously discussed, in some embodiments, the controller 502 may provide automated control of the valves 404, 406 to coordinate function of the hoists 204. In other embodiments, the operation of the valves 404, 406 may be manually controlled.

In block 606, the compressor 410 is used to pressurize the reservoir 408. As previously discussed, the compressor 410 may be powered by standard 110V or 220V utility power, or by a generator. In block 608, the hoists 204 are leveled. Specifically, each hoist 204 is spooled until the weight of the dome roof 102 is equally distributed across all of the hoists 204 in the system. In some embodiments, the positions of each of the inlet valves 404 may be adjusted such that all of the hoists 204 are in the same baseline position. The adjustment of the inlet valves 404 may be done manually but the user or automatically by the controller 502. In some embodiments, the weight sensors 500 may be used to determine when the hoists 204 are level.

In block 610, the outlet valves 406 are opened to lift the dome roof 102. In some embodiments, the outlet valves 406 may be binary on/off valves, such that the controller 502 can only open or close the outlet valves. In other embodiments the outlet valves 406 may offer a range of positions between completely closed and all the way open (e.g., the outlet valves 406 may be needle valves). In such an embodiment, the positions of the outlet valves 406 may correspond to the speed at which the dome roof 102 is raised or lowered, offering more precise control of the system 402. As previously discussed, the positions of the outlet valves 406 may be adjusted manually by the user, or by the controller 502 in response to input by the user via the user interface 508 (e.g., up, down, stop, etc.). As previously discussed, the opening of the outlet valves 406 allows air from the outlet conduits 210 to escape the exhaust 414, creating a pressure difference between the inlet 318 and the outlet 320 of each hoist 204. The pressure difference at the inlet 318 and the outlet 320 of the hoist 204 causes the hoist 204 to spool, raising the dome roof 102.

At decision 612, the process 600 determines whether the dome roof 102 is level. The determination may be made using the weight sensors 500 coupled to the chains 206. For example, if all of the weights measured by the weight sensors 500 are not within a threshold percentage of one another, process 600 may determine that the dome roof 102 is not level. For example, the threshold percentage may be 1%, 2%, 5%, 10%, 15%, 20%, or some other value. If the dome roof 102 is not level, the process 600 moves to block 614 and closes all of the outlet valves 406. Once the outlet valves 406 are closed, the process 600 returns to block 608 and levels the hoists 204 by adjusting the inlet valves 404. In some embodiments, leveling the hoists may include actuating one or more of the outlet valves 406 to release pressure from one or more of the hoists 204. If the process 600 determines that the dome roof 102 is level, the process proceeds to decision 616.

At decision 616, the process 600 determines whether the dome roof 102 has reached the desired height near the top rim 110 of the storage tank 100 for installation of the dome roof 102. If the desired height has been reached, the process 600 proceeds to block 618 and closes the outlet valves 406 to stop the hoists 204 from spooling and lifting the dome roof 102. If the desired height has not been reached, the process 600 returns to block 610 and continues to lift the dome roof 102 by opening the outlet valves 406. It should be understood, however, that if the outlet valves 406 are already open or partially opened, they may remain in their existing position as the process returns to block 610.

The disclosed techniques include using the manifold 400 to provide compressed air to the inlet 318 of the pneumatic or hydraulic hoist 204 and then using an outlet valve 406 to exhaust air from the outlet 320 to create a pressure difference between the inlet 318 and the outlet 320, causing the hoist 204 to spool, thereby lifting or lowering the roof 102. The controller 502 and manifold 400 may be used to level and generally coordinate the operation of multiple hoists 204, resulting in a system that offers continuous coordinated spooling of multiple hoists. Specifically, the manifold 400 allows for the operation of the hoists 204 to be precisely coordinated from a single location.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a plurality of lifts configured to couple to a storage tank about a circumference of the storage tank, wherein each lift of the plurality of lifts comprises:

a hoist;

a coupling configured to extend between the hoist and a roof of the storage tank;

an inlet conduit configured to be coupled to an inlet of the hoist; and an outlet conduit configured to be coupled to an outlet of the hoist;

wherein a pressure difference between the inlet of the hoist and the outlet of the hoist spools the hoist;

the plurality of lifts result in a plurality of hoist, a plurality of couplings, a plurality of inlet conduits and a plurality of outlet conduits;

a reservoir configured to store compressed air; and a manifold configured to fluidly couple the reservoir to each inlet conduit of the plurality of inlet conduits and to fluidly couple each outlet conduit of the plurality of outlet conduits to an exhaust, wherein the manifold comprises a plurality of outlet valves, wherein each outlet valve of the plurality of outlet valves is coupled to one outlet conduit of the plurality of outlet conduits, wherein the plurality of outlet valves is configured to regulate flow between the outlets of the plurality of hoists and the exhaust and wherein the manifold is configured to exhaust air from the respective outlet of a first lift of the plurality of lifts, via the respective outlet valve, to create a pressure differential between the respective inlet conduit and the respective outlet conduit, to cause the first lift to spool.

2. The system of claim 1, wherein the manifold comprises a plurality of inlet valves, wherein each inlet valve of the plurality of inlet valves is coupled to a respective inlet conduit of the plurality of inlet conduits and wherein the plurality of inlet valves are configured to regulate flow between the reservoir and the inlets of the plurality of hoists.

3. The system of claim 2, wherein each lift of the plurality of lifts comprises a weight sensor configured to be coupled to the coupling and wherein the weight sensor is configured to output a signal indicative of a weight supported by the hoist.

4. The system of claim 3, wherein the manifold comprises a user interface configured to receive inputs from a user.

5. The system of claim 4, comprising a controller configured to control the plurality of inlet valves and the plurality of outlet valves based at least in part on the signals output by the plurality of weight sensors and the inputs received from the user via the user interface, wherein the controller comprises a processor.

6. The system of claim 5, comprising a compressor configured to pressurize the reservoir.

7. The system of claim 6, comprising a power source configured to provide power to the controller and the compressor.

8. The system of claim 7, wherein the power source outputs 110V or less.

9. The system of claim 8, wherein the power source comprises a generator.

10. The system of claim 1, wherein the plurality of lifts comprises eight lifts.

* * * * *